United States Patent [19]

Hyodo et al.

[11] Patent Number: 4,962,715

[45] Date of Patent: Oct. 16, 1990

[54] DEVICE FOR CONTROLLING FINISH-UP STITCHING IN AN ELECTRONIC COMPUTER SEWING MACHINE

[75] Inventors: Toru Hyodo; Akira Orii, both of Tokyo, Japan

[73] Assignee: Janome Sewing Machine Co. Ltd., Tokyo, Japan

[21] Appl. No.: 339,237

[22] Filed: Apr. 14, 1989

[30] Foreign Application Priority Data

Apr. 15, 1988 [JP] Japan ..... 3-91285

[51] Int. Cl.[5] ..... D05B 3/02; D05B 27/22

[52] U.S. Cl. ..... 112/451; 112/316; 112/454

[58] Field of Search ..... 112/451, 316, 317, 266.1, 112/456, 458, 453, 454

[56] References Cited

U.S. PATENT DOCUMENTS 4,563,963 1/1986 Hanyu ..... 112/451 X
4,651,663 3/1987 Murakami et al. ..... 112/458
4,781,134 11/1988 Horie ..... 112/451

*Primary Examiner*—Peter Nerbun
*Attorney, Agent, or Firm*—Michael J. Striker

[57] ABSTRACT

Stitching coordinates prior to finish-up stitching are used to produce finish-up stitching data, resulting in undistorted stitching in all cases. Also, stitching data is pre-read out at start-up for stitching patterns continuously and predetermined stitching coordinates are obtained from the stitching data for making initiating finish-up stitching data. Therefore, it is no longer necessary to store the finish-up stitching data or the initiating finish-up stitching data in advance in a programming memory (ROM) so that operating efficiency of the sewing machine is increased.

8 Claims, 7 Drawing Sheets

FIG_1(A)
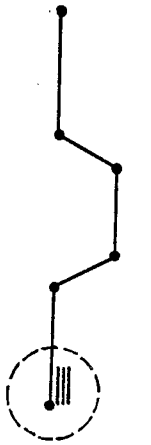
FIG_1(B)
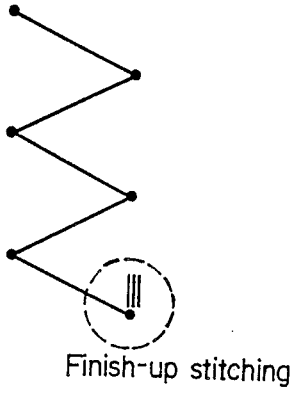
FIG_1(C)
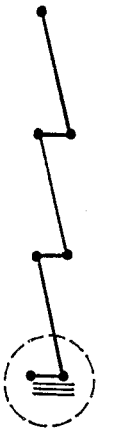
FIG_3
Means of storing stitching coordinate
| | |
|---|---|
| $R_0$ | Present amplitude coordinate |
| $R_1$ | Preceding amplitude coordinate |
| $R_2$ | Present feed coordinate |
| $R_3$ | Preceding feed coordinate |

FIG_8(A)
Initiating finish-up stitching
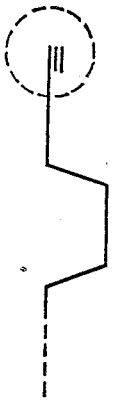
FIG_8(B)
Initiating finish-up stitching
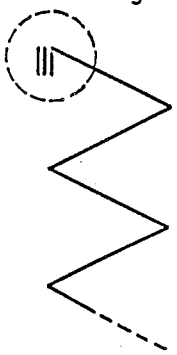
FIG_10
Means storing pre-reading coordinates
| | | |
|---|---|---|
| $R_0$ | First stitching amplitude coordinate $B_0$ | $A_0(B_0, F_0)$ |
| $R_1$ | First stitching feed coordinate $F_0$ | |
| $R_2$ | Second stitching amplitude coordinate $B_1$ | $A_1(B_1, F_1)$ |
| $R_3$ | Second stitching feed coordinate $B_1$ | |

DEVICE FOR CONTROLLING FINISH-UP STITCHING IN AN ELECTRONIC COMPUTER SEWING MACHINE

BACKGROUND OF THE INVENTION

This invention relates to an electronic computer sewing machine, and more particularly to a device for forming finish-up stitches thereof.

The finish-up stitches are formed after or during forming pattern stitches, and they are useful to prevent ravellings and as a sign of finishing the stitching.

The finish-up stitching has been hardly effective in a case of a needle dropping at the same position as the last pattern stitch, and since such a condition has damaged thread, needle dropping positions have been changed but not in a needle amplitude direction, i.e. transverse or oblique to the fabric feeding direction. Stitching data composed of only fine fabric feedings have been determined for applications to all stitching patterns.

However, if such determined finish-up stitching data is used, the patterns are not deformed with respect to stitched parts which are parallel to the fabric feeding direction (along vertical directions in the drawing of FIG. 1) in a straight stitching or a stitching pattern as shown in FIG. 1(A). But, with respect to the stitching patterns containing components in a needle amplitude direction as shown in FIG. 1(B), if the finish-up stitching data is changed in the fabric feeding direction only, the parts of the finish-up stitching are unsightly deformed.

As an improvement therefor, by storing a plurality of stitching data concerning the finish-up stitching in a program memory (ROM), a method has been proposed which selected appropriate finish-up stitching data in response to the patterns before forming the finish-up stitching or a stitching coordinate (Japanese Patent Disclosed Patent Document 194,782/84 "A method of finish-up stitchings in an electronic computer sewing machine"). This method has the following disadvantages:

(1) A plurality of stitching data are required, but the programming memory (ROM) is inferior in efficiency.

(2) Since the stitching data is used, the length to be taken for the finish-up stitching is made fixed, and if changings of the stitching coordinate before forming the finish-up stitching as shown in FIG. 1(C) are smaller than the length of the finish-up stitching, the finish-up stitching part is unsightly deformed.

SUMMARY OF THE INVENTION

Accordingly, it is an object of our invention to provide a device for controlling finish-up stitching providing an initiating finish-up stitching which prevents ravelling when beginning a desired stitching pattern.

The initiating finish-up stitching has been hardly effective in a case of a needle dropping at the same position as the first pattern stitch, and since such a situation has damaged thread, needle dropping positions have been changed but not in a needle amplitude direction. Stitching data composed of only fine fabric feedings have been determined for applications to all stitching patterns.

However, if such determined initiating finish-up stitching data is used, the patterns are not deformed with respect to stitched parts which are parallel to the fabric feeding direction (along vertical directions in the drawing of FIG. 8) in a straight stitching or a stitching pattern as shown in FIG. 8(A).

But, with respect to the stitching patterns containing components in a needle amplitude direction transverse to the fabric feed direction as shown in FIG. 8(B), if the initiating finish-up stitching data is changed in the fabric feeding direction only, the parts of the initiating finish-up stitching are unsightly deformed.

It is also an object of our invention to provide a device for controlling finish-up stitching in an electronic computer sewing machine so that the portions of the initiating finish-up stitching are not deformed in an unsightly manner.

In keeping with these objects and others which will be made more apparent hereinafter, the device for controlling finish-up stitching according to our invention comprises a finish-up information generating means for generating a predetermined finish-up stitching length and stitching number, a means for storing a plurality of stitching coordinates for two successive different stitching positions, a finish-up stitching data making means for obtaining before the finish-up stitching a stitching direction from the stitching coordinates from the stitching coordinate storing means and outputting in correlation with the means for selecting the finish-up stitching so as to define a direction opposite to a finish-up stitching direction and the finish-up stitching data making means also makes finish-up stitching data according to the finish-up stitching length from the finish-up stitching information generating means, whereby a plurality of stitches are formed according to the stitching number from the finish-up stitching information generating means according to the stitching data from the finish-up stitching already performed.

In the invention, the finish-up stitching direction is obtained with reference to the coordinates where two different stitches are formed prior to finish-up stitching, and the finish-up stitching coordinate is determined from said direction and a predetermined length of the finish-up stitching.

The finish-up stitching data is made up from the stitching coordinate before the finish-up stitching and said determined finish-up stitching coordinates, and a stop order for the finish-up stitching is issued after having stitched over the predetermined stitching number.

If the length between the stitches obtained from the different two stitching coordinates before carrying out the finish-up stitching is smaller than the length of the predetermined finish-up stitching, the finish-up stitching data is made up from the different two stitching coordinate before carrying out the finish-up stitching, and the end of the finish-up is ordered after having stitched over the predetermined stitching number. If the length is larger, the finish-up stitching data follows the stitching data of said means of making the finish-up stitching data.

In keeping with the above objects of our invention the device for controlling the finish-up stitching comprises an initiating finish-up stitching information generating means which stores a predetermined initiating finish-up stitching length and a stitching number, a stitching data pre-reading means for reading out from the stitching data generating means the stitching data of two different stitching positions subsequent to operation of the means for selecting the initiating finish-up stitching, a pre-reading coordinate storing means which stores the stitching coordinates from the two stitching positions in accordance with the stitching data and the pattern enlarging-reducing means, an initiating finish-up stitching data making means for making an initiating finish-up stitching data in accordance with a stitching direction obtained from the stitching coordinates of the two different stitching positions and the initiating finish-up stitching length, whereby the stitching pattern following the initiating finish-up stitching is formed after reaching the initiating finish-up stitching number.

In stitching of the pattern to be formed after an initiating finish-up stitching, the different two stitching coordinates at starting of the stitching are pre-read, from which a direction of the initiating finish-up stitching is obtained. The coordiante of the initiating finish-up stitching is determined from the stitching direction and the information of the predetermined initiating finish-up stitching length.

The above determined initiating finish-up stitching coordinate is made the stitching data, and when the stitches are formed up to the predetermined stitching number, the initiating finish-up stitching is ended and stitching patterns are formed following the initiating finish-up stitches.

A comparison is made on the length L between the stitches obtained from the two stitching coordinates different at starting the stitching of the patterns following the initiating finish-up stitch as well as the information P of the predetermined initiating finish-up stitching length. If $L \leqq P$, the different two stitching coordinates are made the stitching data, and when the stitches are formed up to the predetermined stitching number, the initiating finish-up stitching is ended to start the forming of the patterns subsequent to the initiating finish-up stitching. If $L > P$, the stitching follows the stitching data of a means for making up said initiating finish-up stitching data.

BRIEF DESCRIPTION OF THE DRAWINGS

FIGS. 1(A) and (B) are schematic diagrams showing conventional finish-up stitching example (the amplitude is fixed, and the feeding is changed), and FIG. 1(C) is a schematic diagram showing a conventional finish-up stitching example (the amplitude is changed, and the feeding is fixed);

FIG. 3 is a schematic diagram a means for storing stitching coordinates;

FIG. 8A and FIG. 8B are schematic diagrams showing conventional initiating finish-up stitchings (the amplitude is fixed, and the feeding is changed);

FIG. 10 is a schematic diagram a means for storing pre-reading coordinates;

DETAILED DESCRIPTION OF THE INVENTION

EXAMPLE 1

The example of the invention will be explained with reference to the attached drawings.

Figure 2:
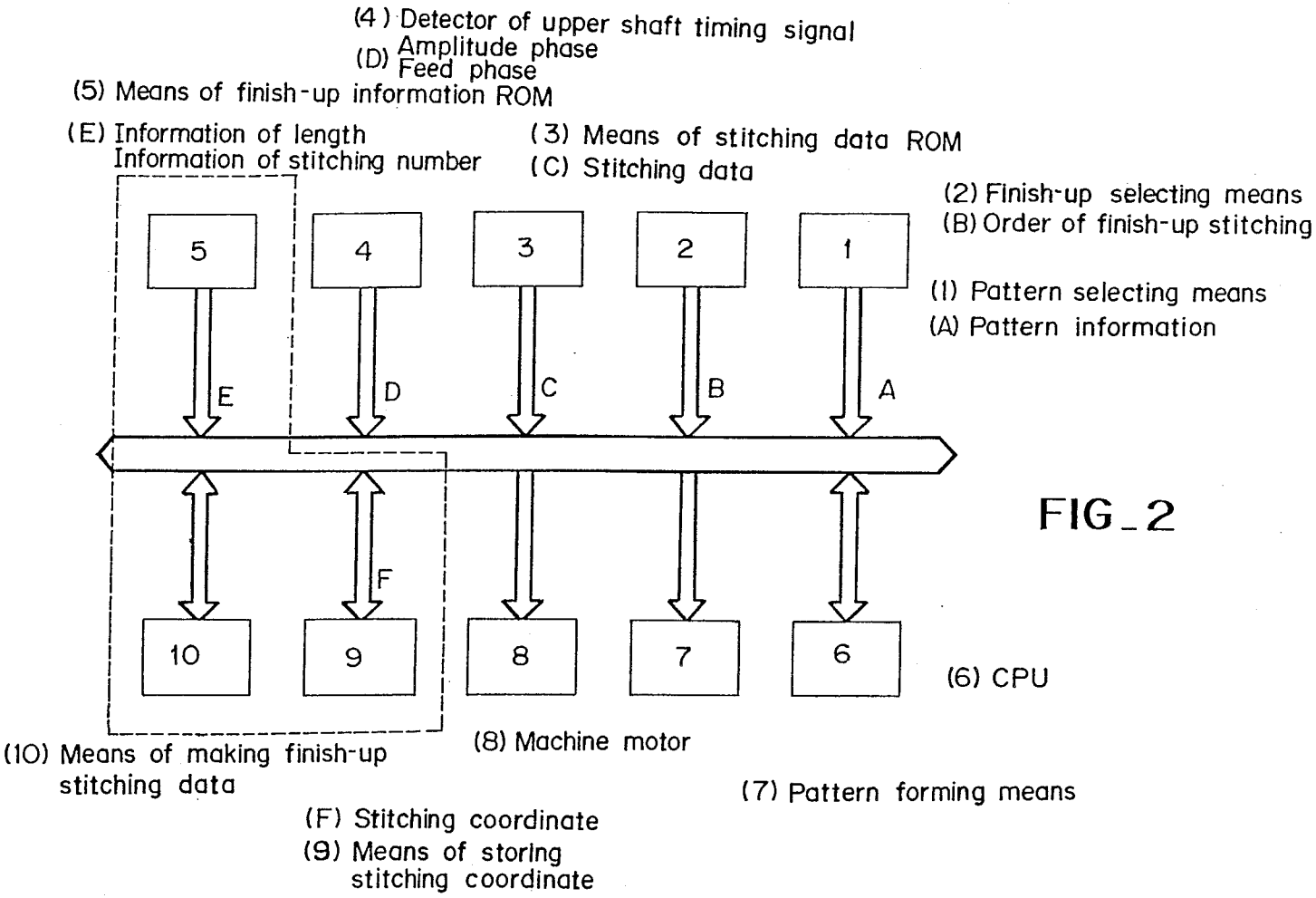
FIG. 2 is an electric control block diagram of one example of an electronic computer sewing machine with a device for controlling finish-up stitching according to our invention.

FIG. 2 shows an example of an electric block diagram of the invention.

A pattern selecting means 1 comprises a plurality of key switches (not shown) for selecting patterns to be stitched, and outputs pattern information or data on command.

A finish-up stitching selection means 2 comprises one key switch, and outputs the command for the finish-up stitching.

A stitching data generating means 3 is a program memory (ROM) which store the needle amplitude data for forming stitching patterns and the stitching data including fabric feeding data, and issues the stitching data.

A detector means 4 of an upper shaft timing signal outputs an amplitude phase information and a feeding phase information in synchronism with the phase of the upper shaft of a sewing machine.

A generator means 5 of the finish-up information is a program memory (ROM) which stores the predetermined stitching length and the stitching number information, and outputs said information in accordance with said finish-up stitching order.

A central processing unit (CPU) 6 controls all of the connected information, and carries out calculations and comparisons in accordance with said information.

A pattern forming means 7 comprises an amplitude actuator (not shown) which controls the displacement or amplitude in the needle amplitude direction and a feed actuator (not shown) which controls the feeding amount in both back and forth feed directions of a fabric to be processed, and drives in accordance with said amplitude phase information and said feeding phase information so as to form stitches.

A machine motor 8 starts, drives and stops in response to the operations of a speed controller (not shown).

The stitching coordinate storing means 9 is a data memory (RAM) which can store, by the two stitchings, the stitching coordinates composed of the amplitude coordinates and the feeding coordinates successively in relation with forming of the stitches and prohibits the storing if the stitching coordinate to be stored is the same as the preceding stored stitching coordinate, so as to always store the different stitching coordinates of the two stitchings.

The finish-up data making means 10 makes and outputs the finish-up stitching data from the stitching coordinates of the two stitchings of the stitching coordinate storing means 9 and the information of the finish-up stitching length of the finish-up stitching information generating means 5, in accordance with the finish-up stitching order.

The operation now will be described.

(1) When a desired stitching pattern is selected from the pattern selecting means 1, the pattern information thereof is output.

(2) The machine motor 8 starts by operating the speed controller (not shown), and the upper shaft of the sewing machine rotates, accordingly.

(3) When the upper shaft is rotated, the upper shaft timing signal detector means 4 outputs the amplitude phase information or the feed phase information in synchronism with each of the rotation phases during one rotation of the sewing machine.

(4) CPU 6 reads out successively the stitching data from the stitching data generator means 3 each time it inputs the amplitude phase information, and obtains the amplitude coordinate from the needle amplitude data so as to drive the amplitude actuator of the pattern forming means 7. Further, it stores the amplitude coordinate in the stitching coordinate stitching means 9.

(5) CPU obtains the feeding coordinate from the fabric feeding data in the above mentioned read out stitching data each time it inputs the feeding phase information so as to drive the feed actuator of the pattern forming means 7. Further, it stores the feeding coordinate in the stitching coordinate storing means 9.

(6) Referring to FIG. 3, the stitching coordinate storing means 9 moves a value stored in R0 (present amplitude coordinate) to R1 (preceding amplitude coordinate) in relation with the amplitude phase information, and stores in R0 an amplitude coordinate obtained from the read out amplitude data.

The means 9 moves the value stored in R2 (present feeding coordinate) to R3 (preceding feeding coordinate) in relation with the feeding phase information, and stores in R2 a feeding coordinate obtained from the fabric feeding data in the read out stitching data.

Figure 4:
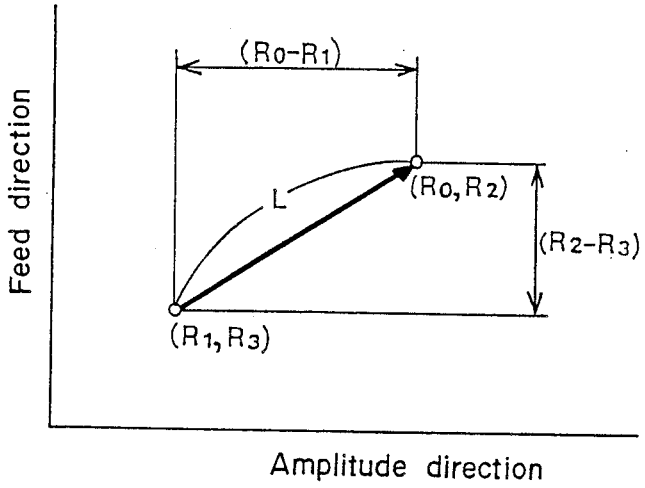
FIG. 4 is a graphical illustration of vector between the stitching coordinates of the example of FIG. 2.

With respect to the moving amount between the stitches, the amplitude direction is, as shown in FIG. 4, (R0–R1) and the feed direction is (R2–R3).

In the present example, for explaining convenience, the feeding coordinates R2 and R3 as the fabric feeding data are treated as absolute values, but actually relative values representing the feeding amount and the feeding direction are used in view of efficiency of the program memory (ROM).

{Actual fabric feeding data}={absolute value of (R2−R3)}+{fabric feeding direction}.

(7) When the finish-up stitching selection means 2 is operated during forming the stitches successively in synchronism with the rotation of the upper shaft of the sewing machine, CPU issues the finish-up stitch ordering information.

(8) CPU 6 makes effective the finish-up stitch ordering information in synchronism with the feeding phase information, and drives the feeding actuator of the pattern forming means 7 to the position of the feeding amount 0 (the same feeding coordinate such that the same position as the stitching position formed before the finish-up stitching is made a stitch from which the finish-up stitching starts.

(9) CPU reads out, from the stitching coordinate storing means 9, R0, R1, R2, R3 which are the information concerning the stitching coordinate in synchronism with the amplitude phase information, and outputs them to the finish-up data making means 10.

(10) CPU reads out the information of a predetermined finish-up stitching length from the finish-up information generating means 5, and outputs it to the finish-up data making means 10.

(11) The finish-up data making means 10 obtains the length L between the stitches before the finish-up stitching from values R0, R1, R2, R3 in accordance with FIG. 4.

$$L = \sqrt{(R0 - R1)^2 + (R2 - R3)^2} \quad \text{(a)}$$

If P is the value of the information of the predetermined finish-up stitching length, Bx is the moving amount in the amplitude direction of the finish-up stitching data, and Fy is the moving amount in the feeding direction thereof, the calculations described below will be made according to comparison in the length of L and P.

Figure 5A:
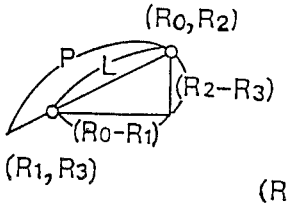
FIG. 5(A) is a graphical illustration of a vector when $L \leqq P$.

(i) in a case of $L \leqq P$ (refer to FIG. 5(A))

$$Bx1 = -(R0 - R1) \quad \text{(b)}$$

$$Fy1 = -(R2 - R3) \quad \text{(c)}$$

Herein, the minus (−) shows the movement in a reverse direction.

Figure 5B:
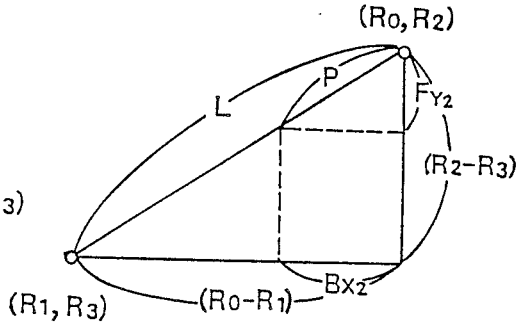
FIG. 5(B) is a graphical illustration of a vector when $L > P$.

(ii) in a case of $L > P$ (refer to FIG. 5(B))

$$Bx2 = -(R0 - R1) \times P/L \quad \text{(d)}$$

$$Fy2 = -(R2 - R3) \times P/L \quad \text{(e)}$$

The stitching data of two stitchings are made from Bx1, Fy1 or Bx2, Fy2.

(1) in a case of $L \leqq P$

| | Amplitude Coordinate | Feeding Coordinate |
|---|---|---|
| Stitching Data (1) | R0 | R2 |
| Finish-up Stitching Data (2) | R1 | R3 |

(2) in a case of $L > P$

| | Amplitude Coordinate | Feeding Coordinate |
|---|---|---|
| Stitching Data (1) | R0 | R2 |
| Finish-up Stitching Data (2) | R0 + Bx2 | R2 + Fy2 |

The most suitable value is selected by the actuator to be coordinate values.

(12) CPU 6 further reads out the information of the predetermined stitching number from the finish-up stitching information generating means 5, and sets them in a counter (not shown).

The stitches are formed while CPU decrements said counter each time it reads out alternately the stitching data of the two stitchings made by the finish-up stitching data making means 10.

(13) When the counter comes up to 0, the sewing machine is stopped to end the finish-up stitching, irrespective of setting of the speed controller.

Figure 6:
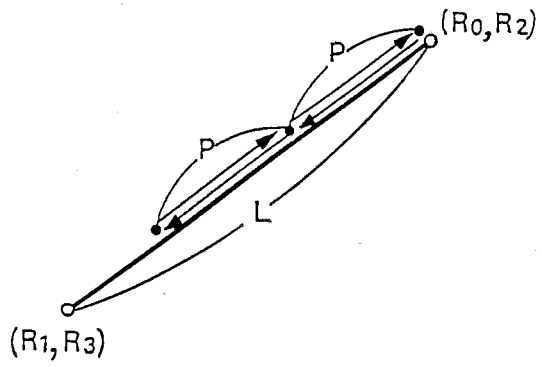
FIG. 6 is graphical illustration of a vector when $L' \geqq nP$ ($N \geqq 2$, n is an integer)

The above statements refer to the basic concept of the present invention. Thus, according to the invention, various finish-up stitchings will be available. For example:

(A) In reference to Bx, Fy obtained when the finish-up stitching data making means 10 is $L \leqq 2P$, the stitching data is also obtained for the coordinates of 2 Bx, 2Fy, whereby if the length between the stitches obtained from the two different stitching coordinates before the finish-up stitching as shown in FIG. 6 is larger than the determined multiple of the predetermined finish-up stitching length, the finish-up stitching direction is obtained in accordance with the two different stitching coordinates, and each of the stitching coordinates of the finish-up stitchings over the determined multiple of the finish-up stitching length is determined.

The finish-up stitching data is made from the stitching coordinates before the finish-up stitching and the determined finish-up stitching coordinates, and when the stitching is carried out over the predetermined stitching number, an order is issued to end the finish-up stitching.

The reason for using the coordinates formed with the two different stitches is to prevent that the stitching is performed at the stitching number predetermined at the same needle dropping so that the effect of the finish-up stitching is decreased and the thread is damaged.

Figure 7:
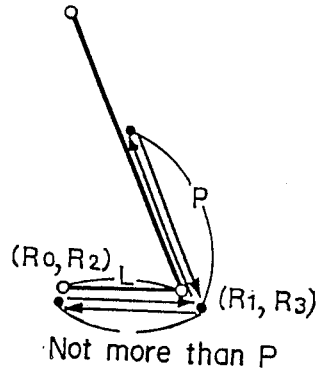
FIG. 7 is a graphical illustration of a vector for another finish-up stitching when $L < P$.

(B) The stitching coordinate storing means 9 stores the different stitching coordinates of three stitchings, and if the finish-up stitching data making means is $L < P$, the stitching data is obtained with respect to the preceding stitching coordinate, thereby to enable the finish-up stitching as shown in FIG. 7.

EXAMPLE 2

Another second example of the invention will be explained with reference to the attached drawings.

Figure 9:
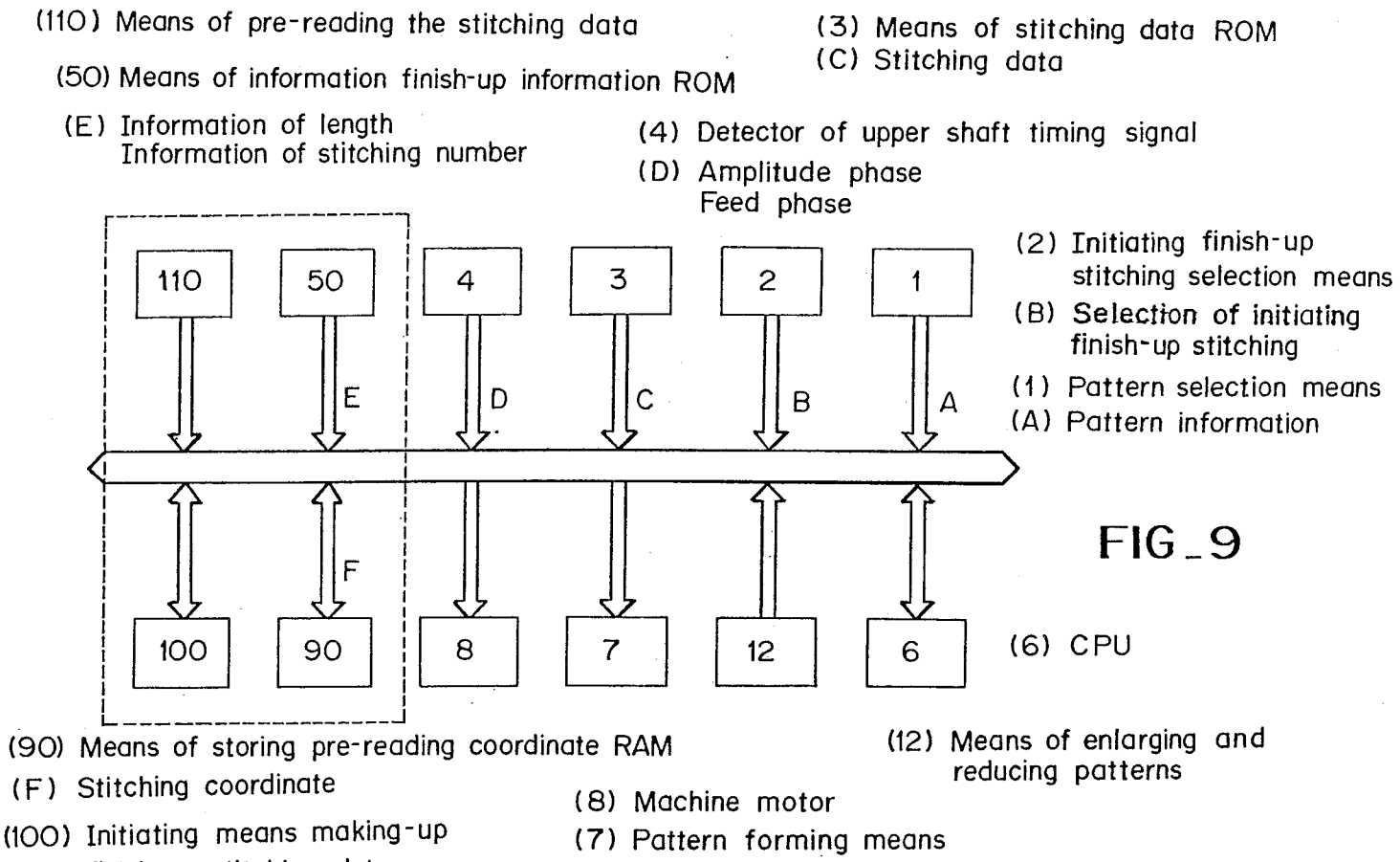
FIG. 9 is an electric control block diagram of an example 2.

FIG. 9 shows an example of an electric block diagram of the invention.

A pattern selecting means 1 comprises a plurality of key switches (not shown) for selecting the stitching pattern, and outputs a pattern information by operations.

An initiating finish-up selecting means 2 includes one key switch, and outputs the information of selecting the initiating finish-up stitching by operations.

A stitching data generating means 3 is a program memory (ROM) issuing the stitching data, which stores needle amplitude data for forming stitching patterns and stitching data including fabric feeding data.

An upper shaft timing signal detector outputs an amplitude phase information and a feeding phase information in synchronism with the phase of the upper shaft of a sewing machine.

An initiating finish-up information generator 50 is a program memory (ROM) which stores the predetermined initiating stitching length and the stitching number information, and issues said information in accordance with said initiating finish-up stitching order.

The central processing unit (CPU) 6 controls all of the connected information, and carries out calculations and comparisons in acordance with this information to control the sewing machine.

A pattern forming means 7 comprises an amplitude actuator (not shown) which controls the amplitude amount in the needle amplitude direction and a feed actuator (not shown) which control the feeding amount of the back and forth directions, of a fabric to be processed, and drives in accordance with said amplitude phase information and said feeding phase information for forming stitches.

A machine motor 8 starts, drives and stops in response to the operations of a speed controller (not shown).

A stitching data pre-reading means 110 reads out the stitching data of the two different stitchings at starting of the stitching pattern following the initiating finish-up stitching from the stitching data generating means 3 in accordance with the selection of the initiating finish-up stitching.

A pattern enlarging-reducing means 12 adjusts sizes of the stitching patterns as the operator's desire, and is in general composed of an amplitude manual key (not shown) for determining the needle amplitude amount and a feed manual key (not shown) for determining the feeding amount of the work fabric. The present means 12 sets automatic values of the stitching pattern selected by the operation of the pattern selecting means 1. The coordinate (amplitude coordinate) of the amplitude actuator is determined by the set values of the needle amplitude data and the amplitude manual keys.

The coordinate (feeding coordinate) of the feeding actuator is determined by the setting values (feeding manual values) of the fabric feeding data and the feeding manual key.

A pre-reading coordinate storing means 90 is a data memory (RAM) which stores, by the two stitchings, the amplitude coordinate obtained from the needle amplitude data and the amplitude manual values (or automatic values) as well as the feeding coordinate obtained from the fabric feeding data and the feeding manual value (or automatic values) in accordance with the stitching data from the stitching data pre-reading means 110.

An initiating finish-up stitching data making means 100 makes and outputs the initiating finish-up stitching data from the stitching coordinates (amplitude coordinate and feeding coordinate) by the two stitchings of the pre-reading coordinate storing means 90 and the information of the initiating finish-up stitching length of the initiating finish-up stitching information generating means 50.

The operation will now be described.

(1) When the desired stitching pattern is selected from the pattern selecting means 1, the pattern information thereof is output.

(2) The pattern enlarging-reducing means 12 determines the amplitude and feeding automatic values with reference to the pattern information.

The amplitude and feeding automatic values are varied in association with the operations of the amplitude manual key (not shown) and the feeding manual key (not shown) so as to generate the amplitude and feeding manual values.

(3) The machine motor 8 starts by the operation of the speed controller (not shown), and the upper shaft of the sewing machine motor.

(4) When the upper shaft is rotated, the upper shaft timing signal detector means 4 outputs the amplitude phase information or the feed phase information in synchronism with each of the rotation phases during one rotation of the sewing machine.

(5) CPU 6 reads out successively the stitching data from the stitching data generator means 3 each time it inputs the amplitude phase information.

The amplitude coordinates are obtained from the needle amplitude data and the amplitude manual values (or automatic values) for driving the amplitude actuator of the pattern forming means 7.

(6) CPU obtains the feeding coordinate from the fabric feeding data of the above mentioned read out stitching data and the feed manual values (or automatic values) each time it inputs the feeding phase information for driving the feed actuator of the pattern forming means 7.

(7) If the initiating finish-up stitching selecting means 2 is selected before the operation of the speed controller, the information of the initiating finish-up stitching selection is output.

(8) CPU 6 makes the stitching data pre-reading means 110 effective in accordance with the information of selecting the initiating finish-up stitching.

The stitching data pre-reading means 110 reads out from the stitching data generating means 3 the stitching data of the two different stitchings at starting of the pattern stitching selected by the pattern selecting means 1.

(9) CPU 6 obtains the stitching data of the two stitchings and the stitching coordinates of the two stitchings from the amplitude manual values (or automatic values) and the feeding manual values (or automatic values) from the pattern enlarging-reducing means 12, and stores them in the pre-reading coordinate storing means 90.

CPU obtains and stores therein the stitching coordinates each time the pattern enlarging-reducing means 12 is operated.

(10) The pre-reading coordinate storing means 90 will be described referring to FIG. 10.

If A0 is the first stitching coordinate of the two stitchings, the amplitude coordinate B0 and the feeding coordinate F0 are stored in the addresses R0, R1 of the data memory (RAM) If A1 is the second stitching coordinate, the amplitude coordiante B1 and the feeding coordinate F1 are stored in the addresses R2, R3 of the data memory (RAM).

(11) CPU 6 reads out the information of the predetermined initiating finish-up stitching length from the initiating finish-up stitching information generating means 50 in accordance with the information of selecting the initiating finish-up stitching, and outputs it to the initiating finish-up stitching data making means 100.

Figure 11:
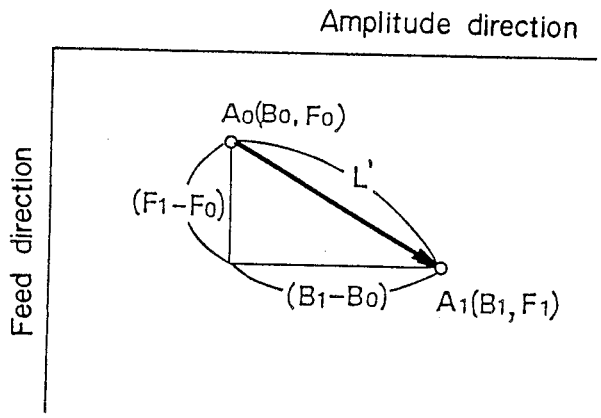
FIG. 11 is a graphical illustration of a vector between the stitching coordinates of example 2.

(12) The initiating finish-up data making means 100 obtains the length L' between the stitches A0 and A1 from the stitching coordinate values of the two stitchings stored in the pre-reading coordinate storing means 90 as shown in FIG. 11.

$$L' = \sqrt{(B1 - B0)^2 + (F1 - F0)^2} \quad \text{(a')}$$

If P' is the value of the information of the predetermined initiating finish-up stitching length, L' and P' are compared with respect to the length, and the stitching data by the two stitchings of the initiating finish-up stitching are made in accordance with the comparison result.

Figure 12:
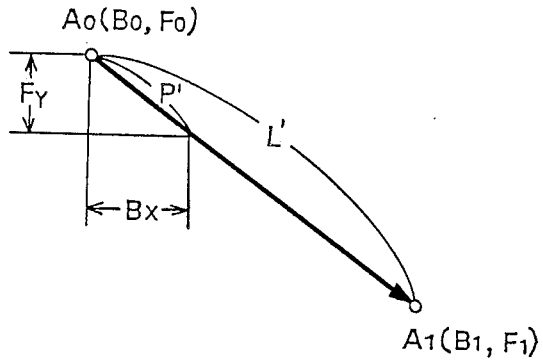
FIG. 12(A) is of a graphical illustration of a vector when $L' \leqq P'$.
FIG. 12(B) is of a graphical illustration of a vector when $L' > P'$.
Figure 12:
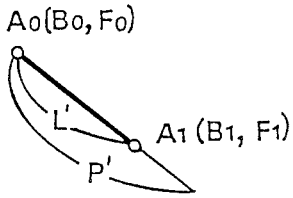

(i) in a case of $L' \leqq P'$ (refer to FIG. 12(A))

| | Amplitude Coordinate | Feeding Coordinate |
|---|---|---|
| Stitching Data S0 | B0 | F0 |
| Initiating Finish-up Stitching Data S1 | B1 | F1 |

-continued

| | Amplitude Coordinate | Feeding Coordinate |
|---|---|---|
| Stitching Data S1 | | |

The stitching data are the same as the stitching coordinates A0, A1 stored in the pre-reading coordinate storing means 90.

(ii) in a case of $L' > P'$ (refer to FIG. 12(B))

If Bx is the displacement in the amplitude direction in response to the length P' of the initiating finish-up stitching, and Fy is displacement in the feeding direction, results will be obtained from the following formulas:

$$Bx = (B1 - B0) \times P'/L' \quad \text{(b')}$$

$$Fy = (F1 - F0) \times P'/L' \quad \text{(c')}$$

The stitching data S0, S1 by the two stitchings are made from Bx and Fy.

| | Amplitude Coordinate | Feeding Coordinate |
|---|---|---|
| Stitching Data S0 | B0 | F0 |
| Initiating Finish-up Stitching Data S1 | B0 + Bx | F0 + Fy |

The initiating finish-up stitching data S0, S1 are obtained each time the pattern enlarging-reducing means 12 is operated.

(13) CPU 6 further reads out the information of the predetermined stitching number from the initiating finish-up stitching information generating means 50, and sets them in a counter (not shown).

(14) The machine motor 8 starts by operating the speed controller (not shown). When the upper shaft of the sewing machine is rotated, PCU 6 reads out alternately the stitching data S0, S1 of the two stitchings made by the initiating finish-up stitching data making means 100 in synchronism with the amplitude phase information from the upper shaft timing signal detector means 4.

The counter (not shown) is decrimented each time reading the stitching data S0, S1.

(15) When the counter comes up 0, the initiating finish-up stitching is ended to start the forming of the stitches continuously from the stitching coordinate A0 at starting of the stitching patterns selected by the pattern selection means 1.

Figure 13:
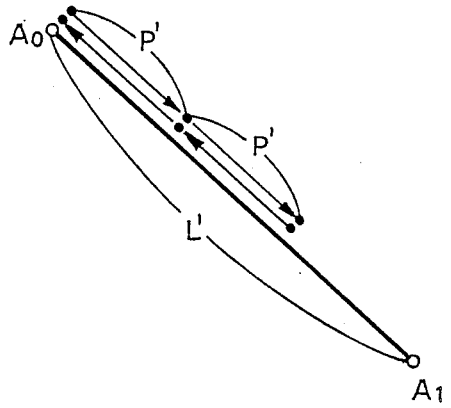
FIG. 13 is of a graphical illustration of a vector of another initiating finish-up stitching when $L' \geqq nP$ ($n \geqq 2$, n is an integer)

The above statements refer to the basic concept of the present invention. Thus, according to the invention, various finish-up stitchings will be available. For example:

(A) When the initiating finish-up stitching data making means 100 is $L' \leqq 2P'$, the stitching data is further made for the coordinates of 2Bx, 2Fy in reference to the obtained Bx, Fy, whereby if the length between the stitches obtained from the different two stitching coordinates at starting of the patterns following the initiating finish-up stitching as shown in FIG. 13 is larger than a certain multiple of the predetermined initiating finish-up stitching length, the stitching direction is obtained from the two different stitching coordinates, and each of the stitching coordinates is successively obtained in reference to the information of the initiating finish-up stitching length up to the determined times of the information of the initiating finish-up stitching length.

The stitches are formed as the stitching data of a plurality of stitching coordiantes up to the predetermined stitching number and then the initiating finish-up stitching is ended to start the forming of the stitches continuously from the initiating finish-up stitching. If the present means is used for the same stitching coordinate, the stitching is carried out at the stitching number predetermined at the same needle dropping so that the effect of the finish-up stitching is decreased and the thread is injured.

For avoiding such an occassion, the two stitching coordinates different at starting of the stitching are used for prevention of the same needle dropping.

Figure 14:
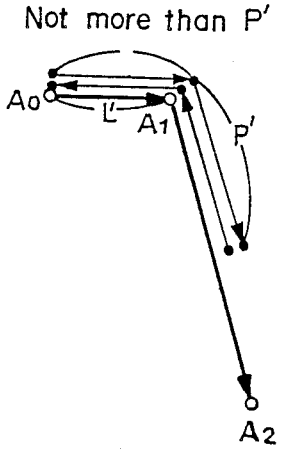
FIG. 14 is of a graphical illustration of a vector of another initiating finish-up stitching when $L' < P'$.

(B) The stitching data pre-reading means 110 reads out the stitching data of the three different stitchings at starting of the pattern stitching from the stitching data generating means 3. The pre-reading coordinate storing means 90 stores the stitching coordinate of the three stitchings after making the enlarging or reducing calculations, whereby if $L' < P'$ is the stitching finish-up stitching data making means 100, the stitching data is similarly made for the second stitching coordinate A1 and the three stitching coordinate A2, thereby enabling to form the initiating finish-up stitching for forming a plurality of different stitches as shown in FIG. 14.

It will be understood that each of the elements described above, or two or more together, may also find a useful application in other types of structures differing from the types described above.

While the invention has been illustrated and described as embodied in a device for controlling finish-up stitching in an electronic computer sewing machine, it is not intended to be limited to the details, shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An electronic computer sewing machine for stitching a fabric according to stitching data, comprising means for selecting a stitching pattern; means for selecting a finish-up stitching; means for generating stitching data for the stitching pattern; pattern forming means for controlling an amplitude in a needle amplitude direction and a feeding amount in a feed direction of the fabric to be stitched in accordance with the stitching data; means for detecting an upper shaft phase of said sewing machine and outputting a value of the upper shaft phase; and a device for controlling the finish-up stitching which avoids unsightly stitching deformation, said finish-up stitching controlling device including finish-up stitching information generating means for generating a predetermined finish-up stitching length and stitching number, means for storing a plurality of stitching coordinates for two successive different stitching positions, a finish-up stitching data making means for obtaining, before the finish-up stitching, a stitching direction from the stitching coordinates from said stitching coordinate storing means and generating an output in correlation with said means for selecting said finish-up stitching so as to define a direction opposite to a finish-up stitching direction, said finish-up stitching data making means also making finish-up stitching data according to the finish-up stitching length from said finish-up stitching information generating means, whereby a plurality of stitches are formed according to the stitching number from said finish-up stitching information generating means.

2. A sewing machine according to claim 1, wherein said finish-up stitching data making means is coordinated with said means for selecting said finish-up stitching and if a length between said stitches obtained before said finish-up stitching from said stitching coordinates from said stitching coordinate storing means is smaller than said finish-up stitching length from said finish-up information generating means, said finish-up stitching data is made according to said stitching coordinates before said finish-up stitching, while, if said length between said stitches is larger, said finish-up stitching data are obtained from said finish-up stitching data making means.

3. An electronic computer sewing machine for stitching a fabric according to stitching data, comprising means for selecting an initiating finish-up stitching; means for generating stitching data for forming a selected stitching pattern; pattern enlarging-reducing means for determining said selected pattern of a desired size; pattern forming means for controlling an amplitude in a needle amplitude direction and a feeding amount in a feed direction of said fabric to be stitched in accordance with the stitching data and said pattern enlarging-reducing means; an upper shaft timing signal detecting means for detecting an upper shaft phase of said sewing machine; and a device for controlling the initiating finish-up stitching, said initiating finish-up stitching controlling device comprising initiating finish-up stitching information generating means which stores a predetermined initiating finish-up stitching length and a stitching number; stitching data pre-reading means for reading out from said stitching data generating means the stitching data of two different stitching positions subsequent to operation of said means for selecting said initiating finish-up stitching; pre-reading coordinate storing means which stores the stitching coordinates from said two stitching positions in accordance with the stitching data and said pattern enlarging-reducing means; initiating finish-up stitching data making means for making an initiating finish-up stitching data in accordance with a stitching direction obtained from the stitching coordinates of said two different stitching positions and said initiating finish-up stitching length, whereby the stitching pattern following the initiating finish-up stitching is formed after reaching the initiating finish-up stitching number.

4. A sewing machine according to claim 3, wherein said initiating finish-up stitching data making means compares a length between stitches derived from said stitching coordinates of said two different stitching positions from said pre-reading coordinate storing means and said initiating finish-up stitching length, and if said initiating finish-up stitching length is larger than or equal to said length between said stitches obtained from said stitching coordinates, said initiating finish-up stitching data is produced, but, if said initiating finish-up stitching length is smaller, said initiating finish-up stitching data are derived from said initiating finish-up data making means.

5. An electronic sewing machine, comprising means for storing stitch data for a plurality of different stitch patterns; selective operating means selecting a stitch pattern from the stitch data storing means; means for detecting predetermined phases of an upper drive shaft of the sewing machine to read out stitch data for a selected stitch pattern from the stitch data storing means; stitch forming means operable under control of the selected stitch data to produce the selected stitch pattern with predetermined needle amplitudes and feed amounts; means for storing data of a predetermined length and a number of finish-up stitches to be made; means for initiating a finish-up stitching operation; means for storing stitch coordinates of two successive different stitches of the stitch pattern; and means responsive to actuation of said finish-up stitching operation initiating means for defining a stitching direction from the two successive different stitches immediately before the finish-up stitches to be made, said finish-up stitching direction being defined along a line extending from the last one of said two successive stitches back to the preceding one, said stitching direction defining means preparing data for finish-up stitch on the basis of the data stored in said finish-up stitch length and number storing means, so that the finish-up stitches are formed in the stitching direction immediately after formation of the selected stitch pattern.

6. A sewing machine according to claim 5, wherein said stitching direction defining means prepares the finish-up stitch data on the basis of the coordinates of the two successive different stitches when the distance between the two successive stitches is shorter than the predetermined length of said finish-up stitches stored in said finish-up stitch length and number storing means.

7. An electronic sewing machine, comprising means for storing stitch data for a plurality of different stitch patterns; selective operated means for selecting a stitch pattern from the stitch data storing means; means for detecting predetermined phases of an upper drive shaft of the sewing machine to read out stitch data for a selected stitch pattern from the stitch data storing means; and stitch forming means operable under the control of the selected stitch data to produce the selected stitched pattern with predetermined needle amplitudes and feed amounts; means for storing data for a predetermined length and number of finish-up stitches to be initially made prior to starting a formation of the selected stitch pattern; means for initiating the initial finish-up stitching operation; means responsive to operation of said initial finish-up stitch initiating means for reading out from said stitch data storing means the data for two successive different stitches of the selected pattern which are to be formed immediately after termination of the finish-up stitches to be initially formed prior to formation of said selected stitch pattern; means for storing the coordinates of the two successive different stitches of the selected pattern; and means for defining a stitching direction from the coordinates of the two successive different stitches and determining stitch coordinates on a basis of the length data stored in said initial finish-up stitch length and number data storing means, to thereby prepare data for the finish-up stitches to be initially formed prior to starting the formation of the selected stitch pattern, so that the finish-up stitches are initially formed in response to the initial finish-up stitching order and then the selected stitch pattern is stitched in response to operation of said pattern selecting means.

8. A sewing machine according to claim 7 wherein said initial finish-up stitch data preparing means prepares the data for the initial finish-up stitches on a basis of the coordinates of the two successive different stitches to be formed immediately after the termination of the initial finish-up stitches when a distance between the two successive different two stitches is shorter than the predetermined length of the initial finish-up stitches stored in said initial finish-up stitch length and number data storing means.

* * * * *